US006272775B1

(12) United States Patent
Schmidt et al.

(10) Patent No.: US 6,272,775 B1
(45) Date of Patent: Aug. 14, 2001

(54) REAR DUMPING DRAGLINE BUCKET AND RIGGING SYSTEM

(75) Inventors: Don F. Schmidt, 3000 N. 4th St., Unite #324, Bismarck, ND (US) 58501; DuWayne A. Marthaller, Mandan, ND (US); Karl Lemmerman, Bismarck, ND (US); Dean Bray, Bismarck, ND (US); William Lengenfelder, Bismarck, ND (US); R. Steven Metzger, Casper, WY (US)

(73) Assignees: Don F. Schmidt; Dakota Coal Company, both of Bismarck, ND (US)

( * ) Notice: Subject to any disclaimer, the term of this patent is extended or adjusted under 35 U.S.C. 154(b) by 0 days.

(21) Appl. No.: 09/386,524

(22) Filed: Aug. 30, 1999

Related U.S. Application Data

(60) Provisional application No. 60/098,849, filed on Sep. 2, 1998.

(51) Int. Cl.[7] ..... E02F 3/60

(52) U.S. Cl. ..... 37/399; 414/726

(58) Field of Search ..... 37/398, 399, 400, 37/401, 444, 445; 414/718, 719, 722, 725, 726, 727, 728

(56) References Cited

U.S. PATENT DOCUMENTS

| | | | | |
|---|---|---|---|---|
| 955,285 | | 4/1910 | Reise . | |
| 1,016,860 | | 2/1912 | Weeks . | |
| 1,070,405 | | 8/1913 | Butler . | |
| 1,104,771 | | 7/1914 | Bjorge . | |
| 1,118,724 | | 11/1914 | Albert . | |
| 1,139,559 | | 5/1915 | Morris . | |
| 1,275,548 | | 8/1918 | French . | |
| 1,342,759 | | 6/1920 | Pugh . | |
| 1,512,936 | | 10/1924 | Knapp . | |
| 1,765,089 | * | 6/1930 | Morin | 37/443 |
| 1,791,526 | * | 2/1931 | Green | 37/401 X |
| 2,096,773 | | 10/1937 | Weimer . | |
| 2,200,315 | | 5/1940 | Weimer | 37/135 |
| 2,719,641 | * | 10/1955 | Pilch | 414/704 |
| 5,400,530 | | 3/1995 | Schmidt | 37/399 |
| 5,469,647 | * | 11/1995 | Profio | 37/398 |
| 5,499,463 | * | 3/1996 | Profio et al. | 37/398 |

* cited by examiner

*Primary Examiner*—Victor Batson
(74) *Attorney, Agent, or Firm*—Westman, Champlin & Kelly, P.A.

(57) ABSTRACT

An excavator dragline bucket is supported by a hoist line from a dragline power unit, and pivots about the connection of the hoist line to the bucket. The bucket is designed to dump toward the rear, and has a gate that is latched in position during the loading of the bucket, and which will be automatically unlatched as the bucket tilts rearwardly. The gate is connected through a double pivoting bellcrank that is operated by control links connected to the hoist member such that as the angle between the bucket and the hoist member changes, the control link loads the double pivoting lever and releases the latch. When the bucket has been dumped and is returned to its horizontal position, the tailgate first moves against the rear edges of the bucket, and subsequently the double pivoting lever permits the tailgate to slide along its plane to a latched position.

16 Claims, 9 Drawing Sheets

56
54
48
68
10
46
49
58
59
44
45
45A
53B
6
61C
62B
60B
6
51B
61B
63B
12

24
22
20
18
38
41
36
34
30
32
10
12
68
56
48
49
58
60B
54
46
59
44
50
53B
51B
45
53C
63B
61C
62B 41
34
36
56
68
12
18
30
22
54
32
16
24
46
48
20
59
10
44
58
60B
45

REAR DUMPING DRAGLINE BUCKET AND RIGGING SYSTEM

This application claims the benefit of U.S. Provisional Application No. 60/098,849, filed Sep. 2, 1998.

BACKGROUND OF THE INVENTION

The present invention relates to a rear dumping dragline bucket and rigging system (rear dumping dragline bucket) that has a tailgate that will be released/opened when the bucket is tilted rearwardly enough so that the rigging is oriented in a selected manner, and which will be automatically reset when the bucket returns to its operative position.

Various rear dumping dragline buckets have been advanced in the prior art. An early excavating bucket which had a latched door at the rear end is illustrated in U.S. Pat. No. 955,285. This patent, however, had a single latch in the center of the door, and utilized a separate arrangement whereby the bail on the bucket, which was pivotally mounted and attached to the hoist line, would pivot forwardly and have a latch dog member that engaged a bellcrank, which in turn operated on a link that hooked another bellcrank which was used to lift the latch to undo the rear door. It is apparent that the total pivoting of the bail required a substantial amount of movement of the bucket, into a vertical position, before unlatching, and the use of mechanically engageable members would be likely to be unreliable.

U.S. Pat. No. 1,118,724 also shows a shovel bucket that has a rear dump door controlled by a rather complex latch that is operated through a lever and chain arrangement. The chain is driven by a separate sheave that would be rotated to pull the chain and release the latch.

Various other buckets that have rear dumping capabilities with doors that are latched during loading and swing, and unlatched by various apparatus have been advanced in the art, but a fully reliable arrangement that provides for essentially automatic operation on a fool-proof basis has been lacking. A bucket which permits rear dumping, but without a separate door is shown in U.S. Pat. No. 5,400,530.

A rear dumping dragline bucket will increase the efficiency of operation of a dragline by permitting discharging overburden at a greater dump radius distance from the dragline power unit and depending on individual hoist rigging requirements, at a higher height than with a forward dumping bucket and rigging system. A need thus exists for a reliable rear dumping bucket.

SUMMARY OF THE INVENTION

The present invention relates to a reliable Rear Dumping Dragline Bucket that is provided with a double-hinged rear door or gate to ensure that the bucket can be adequately loaded, and with an automatically operated latch for releasing the gate during the dumping cycle. A unique lever arrangement is tied in with the hoist line rigging in the present invention so that the rear gate releases reliably, and the latch is made to ensure that when the bucket is returned to its operating position, the gate will be permitted to swing closed against the rear bucket's sidewall and floor/bottom edges and latch reliably.

Specifically, the present invention relates to a Rear Dumping Dragline Bucket that has a rear gate that is mounted onto the rear sidewalls of the bucket adjacent to the top edges, through a pair of double pivot lever (bellcrank) arrangements, so the end gate can be lifted essentially parallel along the plane of the bucket sidewalls for unlatching during initial movement of the levers, and permitted to swing outwardly about the second pivot of the lever when the dragline bucket moves to a dumping position.

The operating linkage is a cable or chain attached to the bucket hoist chain spreader bar, that will provide tension load on the double pivot levers as the rear dump bucket is permitted to tilt rearwardly for dumping.

A tagline is utilized for controlling the angular position of the plane of the bottom of the bucket relative to the ground, or in other words, a horizontal level control is exerted by the tag line. The rigging includes a spreader bar on the hoist chains, as shown. The exact mounting of the hoisting chains is not critical to the performance of the end gate used for rear dumping.

The rigging shown is by way of illustration, and again various types of tag lines can be utilized, as well as different operating linkages for moving the double pivoting levers for releasing the end gate from the latches and permitting it to swing open.

The rear dumping bucket of the present invention provides the advantages that are present in previous rear dumping buckets; that being of discharging overburden at a farther distance from the dragline power unit and possibly at a great dump height than conventional forward dumping buckets. Additional, the present invention will increase productivity through a reduction in both the loading and dump cycles. This is accomplished due to: (1) The ability to hoist a loaded bucket closer to the dragline's boom point, thus reducing the loading cycle and (2) a quicker dumping bucket as a result of the rear dumping dragline bucket and rigging system. The rear dumping bucket and rigging system will permit excavating a deeper and/or wider pit while increasing the effective load from each bucket hoisted, as compared to a conventional front dumping bucket.

DESCRIPTION OF THE PREFERRED EMBODIMENTS

Figure 1:
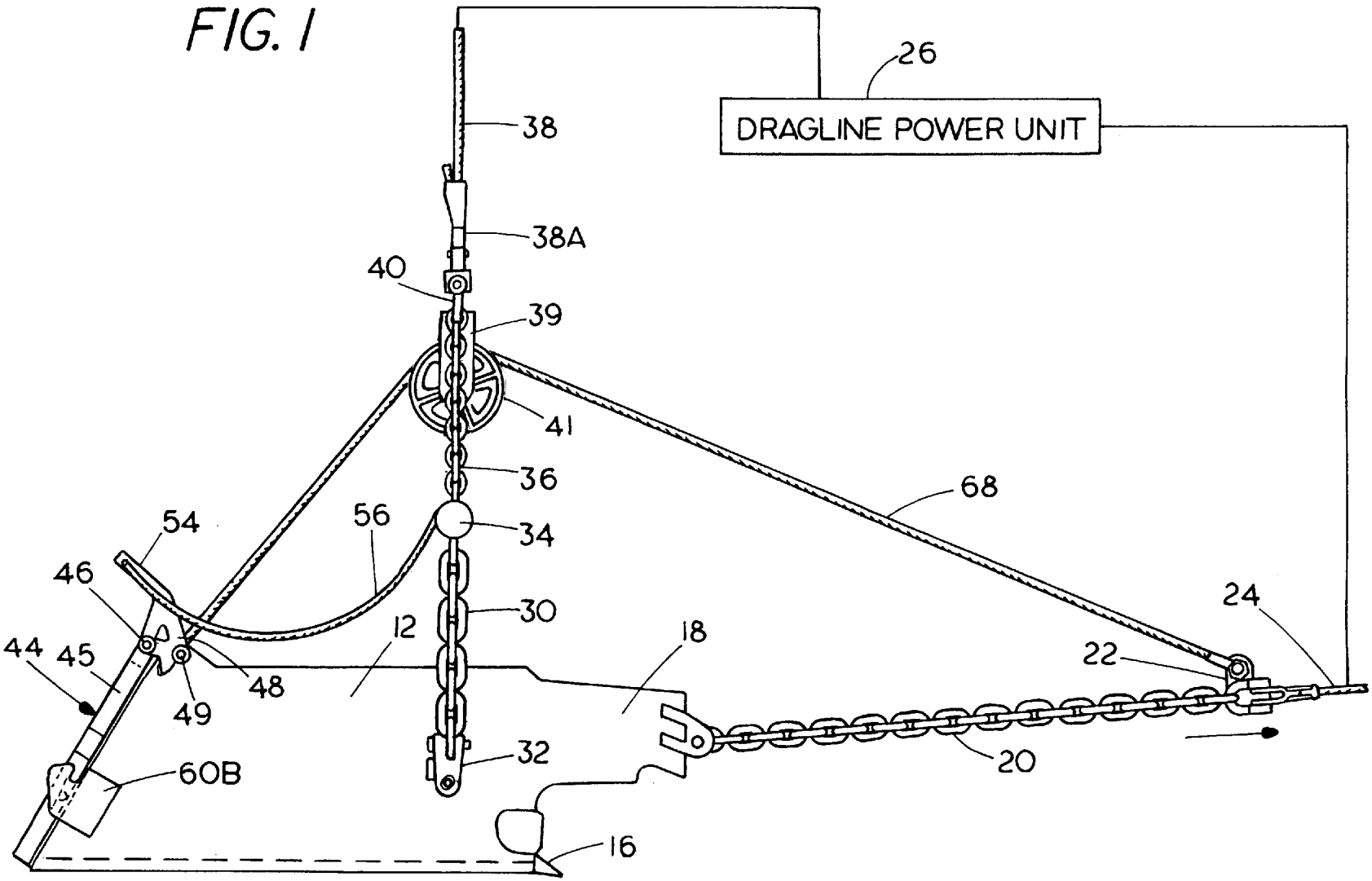
FIG. 1 is a side elevational view of a rear dumping bucket having an end gate made according to a first form of the present invention installed thereon.
Figure 2:
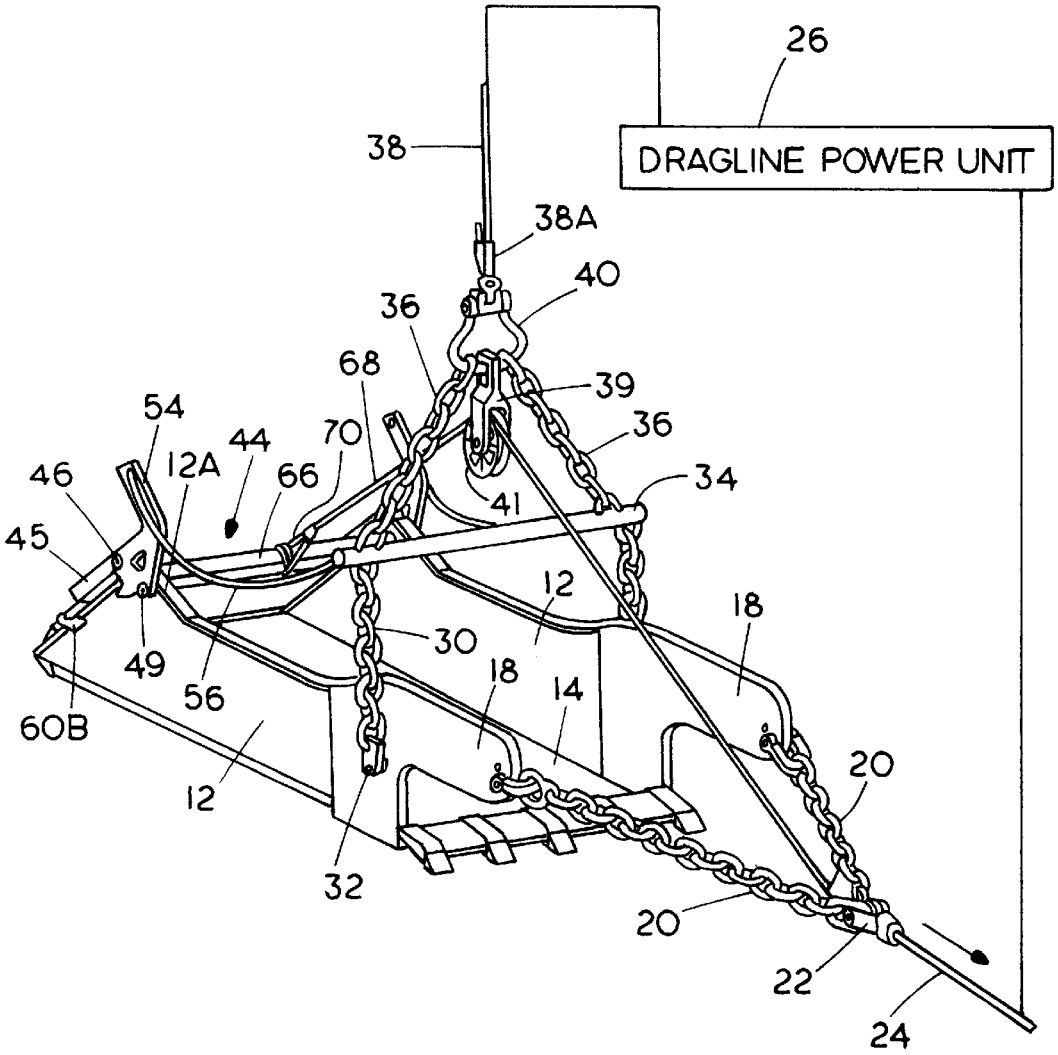
FIG. 2 is a front perspective view of the bucket of FIG. 1.

A bucket illustrated generally at 10 is a dragline bucket that is formed with sidewalls 12, a floor 14, and excavator teeth 16 at the forward end of the floor in a conventional manner. Cheek plates 18 are mounted at the forward ends of the sidewalls 12, and provide for attachment of drag chains 20. The drag chains 20 are attached through a common clevis 22 on which the drag cable 24 is attached. Drag cable 24 is controlled through a conventional set of drag cable sheaves on a dragline power unit 26 shown schematically.

The bucket 10 has hoist chains 30 pivotably mounted on brackets 32 using suitable connections, on each sidewall 12 in a selected position relative to the center of gravity of the bucket. A spreader bar 34 is connected to the top of the hoist chains 30, and additional hoist chains 36 extend up from the spreader bar 34 to a clevis 40 that attaches to a hoist cable 38 through a cable termination end 38A. A housing 39 is supported on clevis 40 and supports a rotatable tag line sheave 41. The sheave 41 is spaced a desired amount above the spreader bar or equalizer bar 34.

The bucket 10 has an end gate or tailgate assembly 44 mounted at the rear end of the bucket, to close the space between the sidewalls 12. The end gate 44 is partial height, but it will enclose the end of the bucket 10 and extend from the floor 14 up a desired amount to permit filling the bucket adequately. The end gate 44 can be suitably reinforced, and carries latchbars for holding the end gate closed. Side frame members 45 are supported onto a top cross frame member 45A (see FIG. 3) and are to the outside of walls 12. Pivot pins 46 on the opposite sides of the bucket hold upper ends of the side frame member 45 at first pivot points of bell crank-type levers 48 on each side of the bucket 10. The bellcranks 48 are mounted on pivot pins 49, which are supported on suitable ears 12A that extend upwardly above the upper edges of the major portion of the sidewalls 12. Bellcrank levers 48 each have an arm actuator 54 that extends upwardly, on each side of the bucket, and the arms 54 are each connected to a suitable chain or cable 56 on each side of the bucket 10 forming flexible links. The chains or the cables 56 in turn are adjustably fastened to the spreader bar or equalizer bar 34. The bellcranks 48 also each have an end gate actuating arm 58 that is positioned between the pivot pins 46 and 49, and which is forwardly of the end gate 44 and frame members 45, which align with the side frame member 45.

The end gate 44 carries a pair of latch assemblies 42 thereon, one to the right and one to the left and these latch dog assemblies 42 comprise tubular latch dogs 43A and 43B which are pivotally mounted as at 47A and 47B on the rear wall panel 50 of the end gate 44. The panel 50 is a solid steel panel that is supported by a framework including cross member 45A and tubular frame end uprights 45C and 45D for reinforcements in desired locations. The latch bars 43A and 43B have circular cross sections and end portions 51A and 51B which extend laterally out through slots 53A and 53B the frame side uprights. The end members are guided in suitable guide or wear straps, one of which is shown at 53C in FIG. 9 so that they can move up and down generally as indicated by the arrows 53F.

Figure 3:
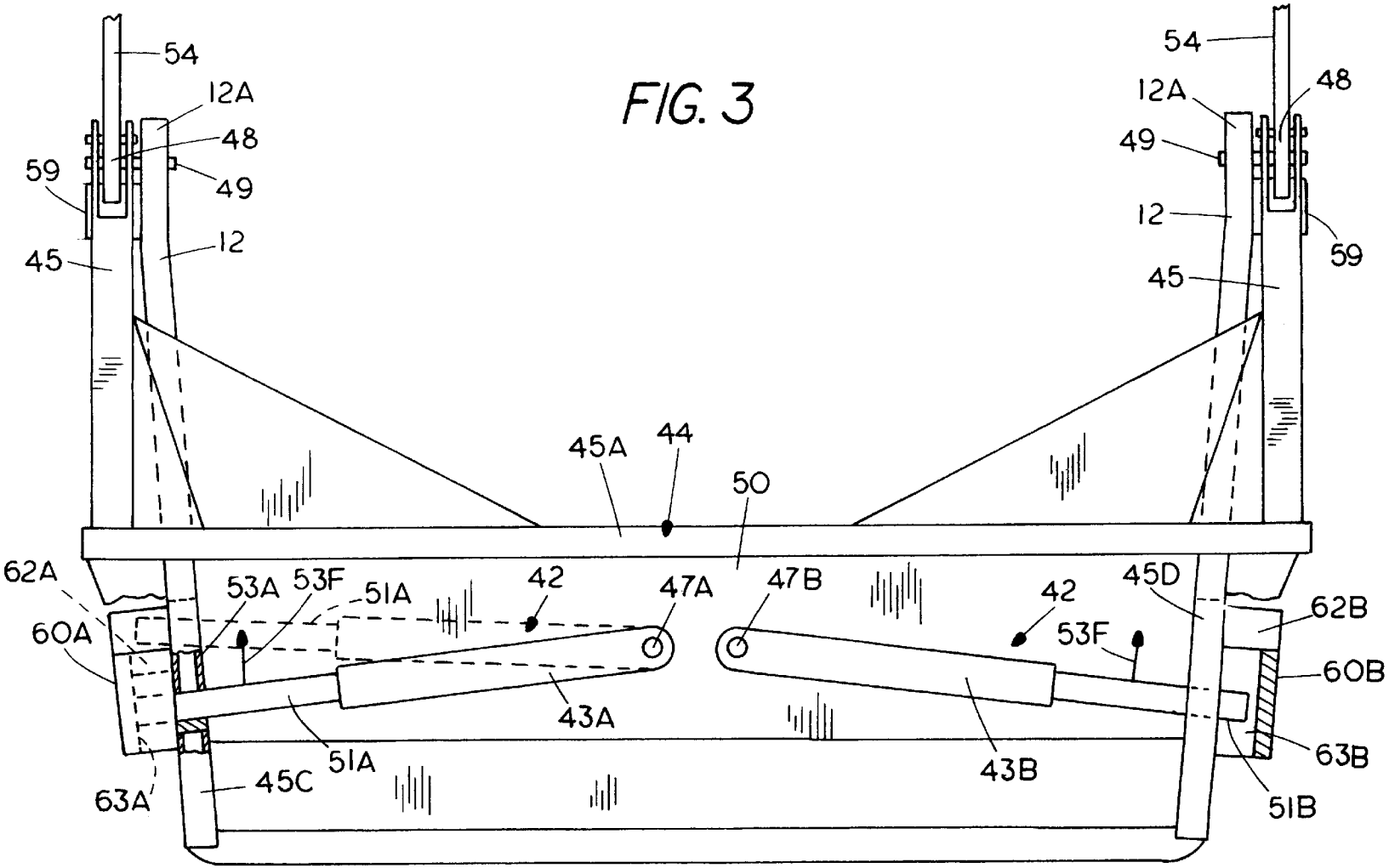
FIG. 3 is an enlarged rear view of the bucket of FIG. 1.
Figure 4:
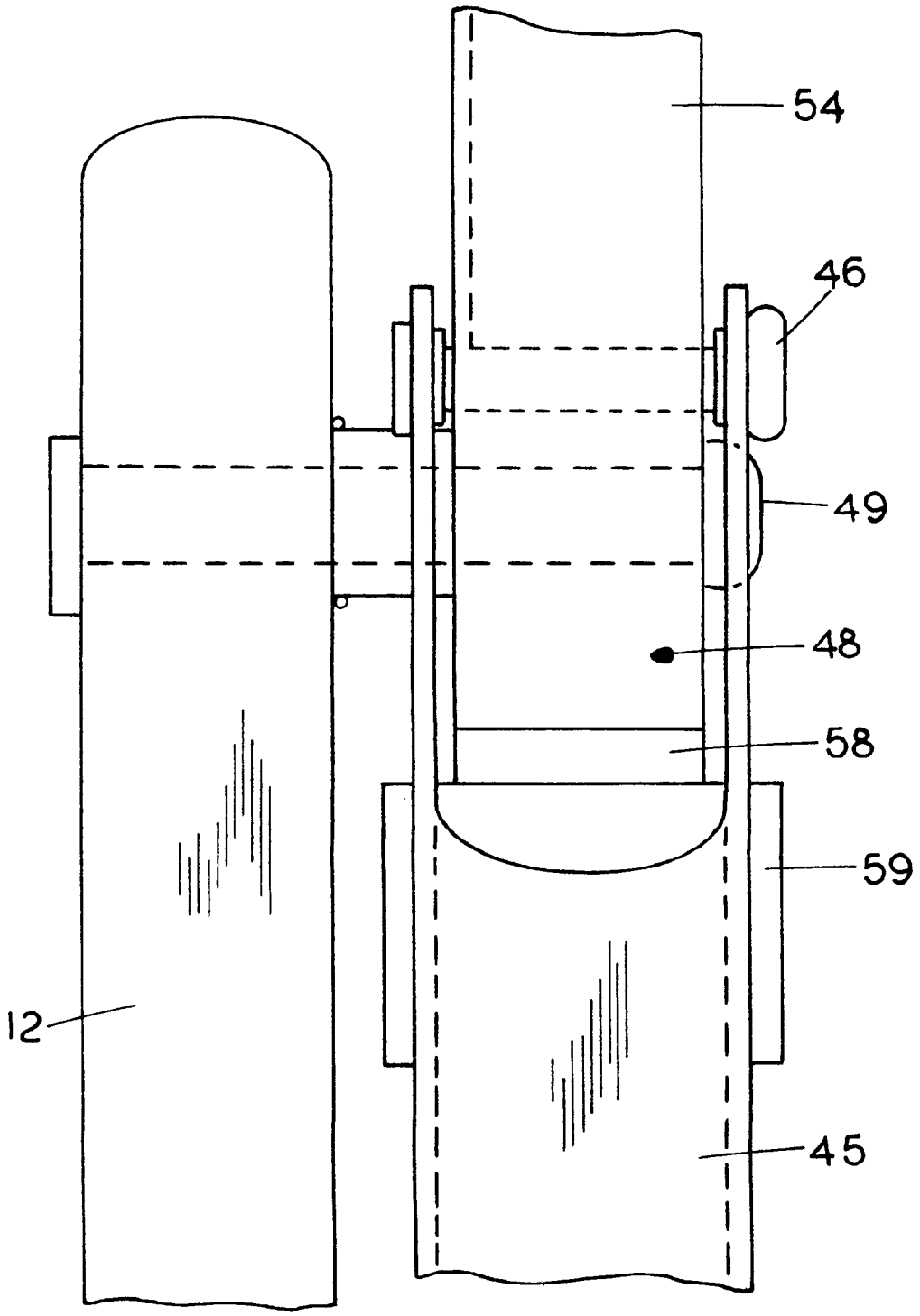
FIG. 4 is an enlarged rear view of a bellcrank actuator used with the end gate of the present invention.
Figures 6, 7:
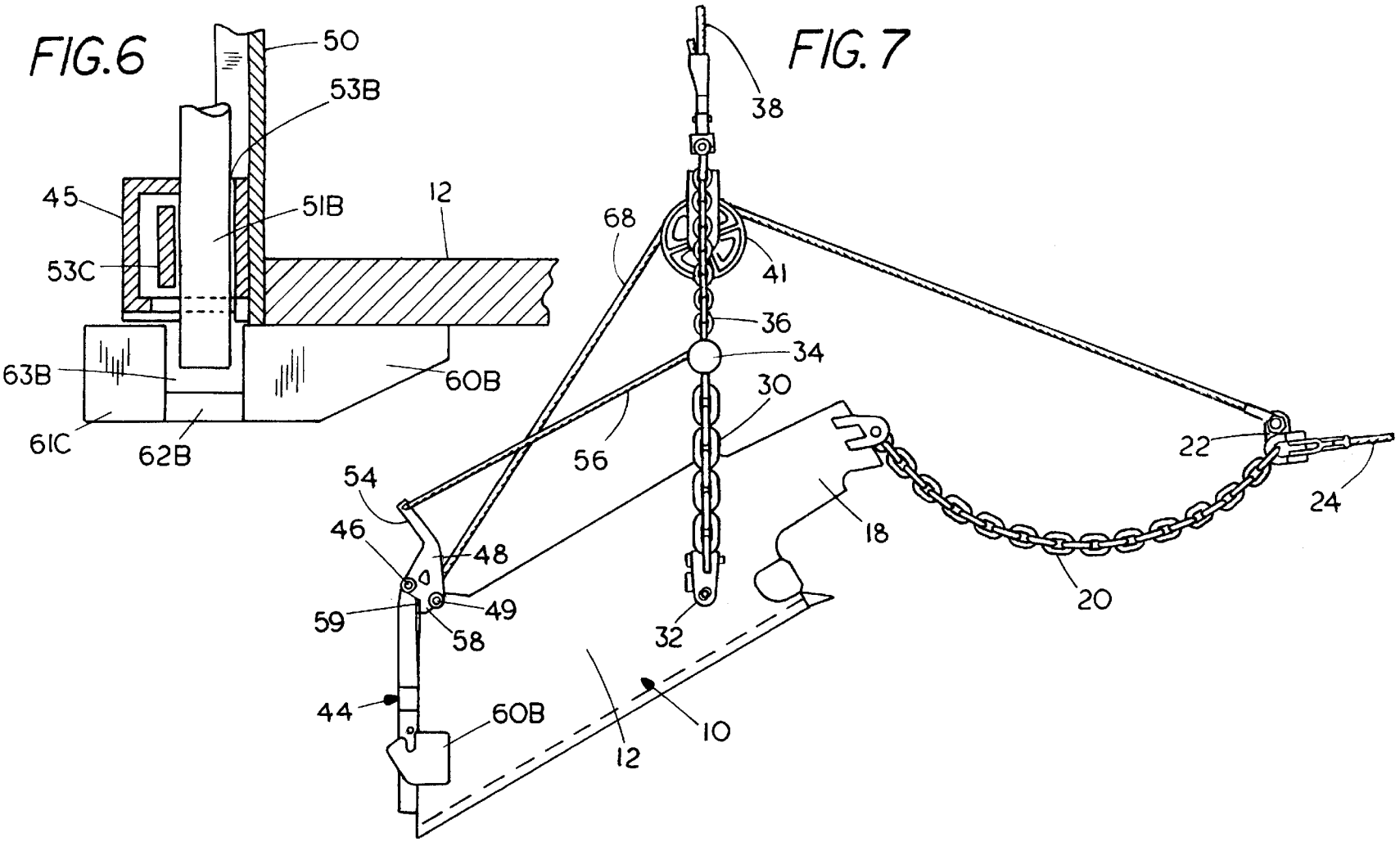
FIG. 6 is a fragmentary enlarged top view of a latch used for the end gate of the present invention taken on line 6—6 in FIG. 5.
FIG. 7 is a side view illustrating the rear dump bucket pivoted rearwardly so the double pivot lever has lifted the end gate to unlatch it.

The end portions 51A and 51B are made to fit into latch plates 60A and 60B that are mounted on the outsides of the side walls 12, and have rounded hook ends 61A and 61B that define a notch 62A and 62B, respectively. There is a wide slot 63A and 63B that is milled into the side of the respective latch plate which will receive the end portions 51A and 51B. The slots are shown in FIG. 6 at 63B, and there is another slot 63A on the opposite side on the latch member 50A as seen in FIG. 3.

Figure 9:
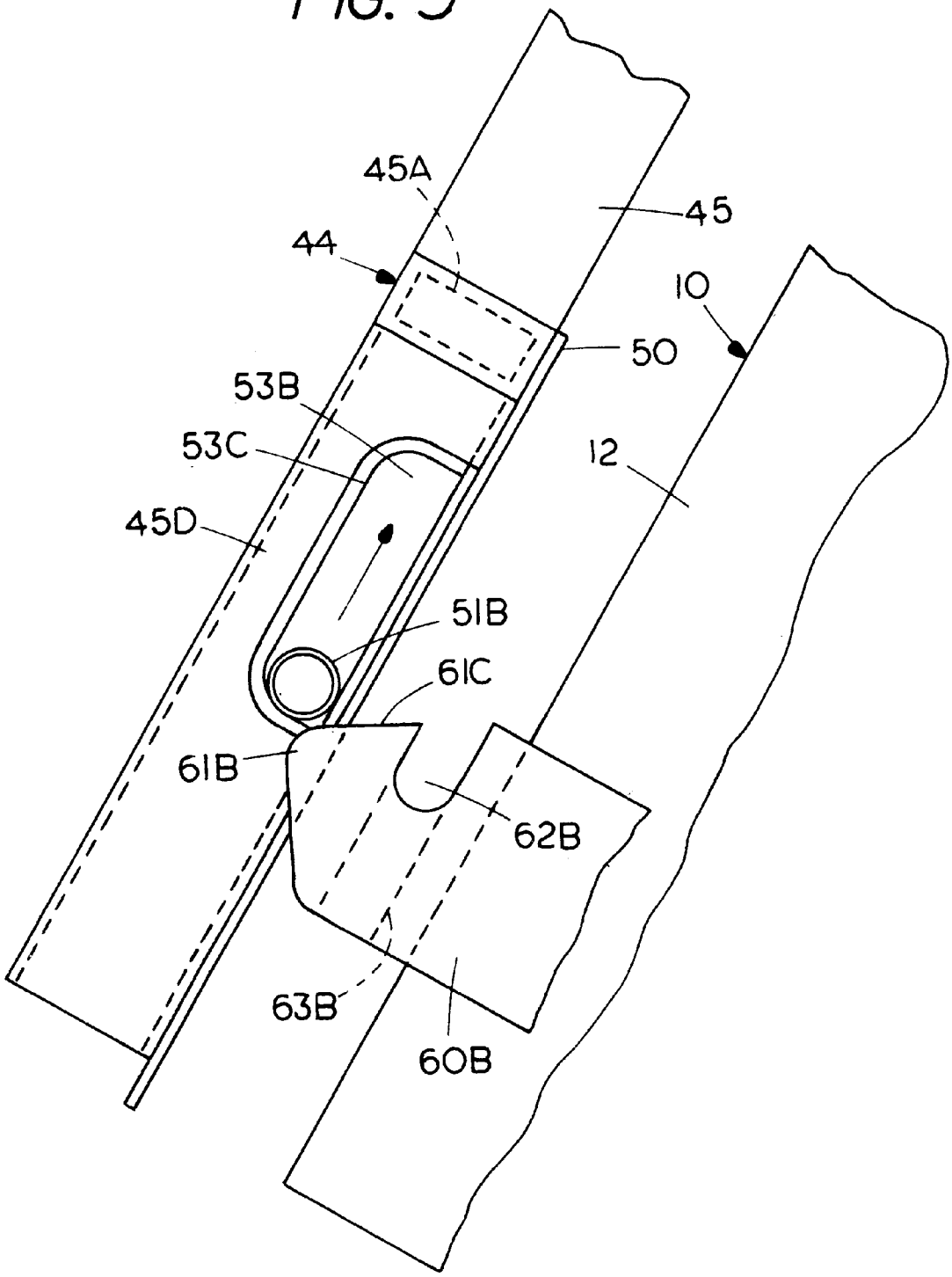
FIG. 9 is an enlarged side view of a latch shown with the end gate approaching a latched position after dumping as the bucket is being moved to is working position.

The rounded ends 61A and 61B are made so that they will provide an inclined surface such as that shown at 61C in FIG. 9 for lifting the latch dog end portions 51A and 51B as the tail gate 44 moves toward a closed position. The latch dog end portion 51A and 51B will slide down into the slots 63A or 63B of the respective latch plates, 60A and 60B, and the end gate will be held in the locked, closed position. The end gate 44 provides a closed rear end wall for the dragline bucket so that the dragline bucket can be filled full, prior to dumping, and then the end gate can open for dumping after it is actuated. The notches 62A and 62B are provided so that the bucket and end gate are skewed as the end gate closes, the latch dog end portion s will be held in the open notches, even if an end portion does not slide into the provided slot.

The bucket 10 is provided with a rear cross bar or tube 66, that braces the sidewalls 12, 12 and keeps them in proper position, as well as providing structural strength for attachment of a tag line cable or chain 68 as shown at 70, on the cross bar 66. The attachment 70 can be a bracket, clevis, or made by wrapping the cable onto the crossbar using a cable clamp.

The rigging shown is all that is necessary for operating the rear dump bucket of the present invention using the unique end gate latching arrangement. When the bucket 10 is filled in a normal manner by exerting a load on the drag cable 24, through the action of the excavating teeth 16 and the normal weight of the bucket, while the hoist line 38 is slackened sufficiently, the hoist line 38 is then tensioned to raise the bucket 10 using the power unit 26, and the bucket 10 will be hoisted and swung to its dumping location. Tension on the drag cable 24 will be controlled to maintain the bucket 10 in the proper orientation about the pivots formed at the brackets 32 holding the hoist chains 30 in place. The pivot axis formed by brackets 32 is positioned ahead of the center of gravity of the bucket 10, either empty or loaded so the bucket tends to pivot rearwardly. That is so the rear of the bucket will drop when the drag cable 24 is slackened. The load on the cheek plates from the drag cable 24 controls the load tending to pivot the bucket.

Figure 5:
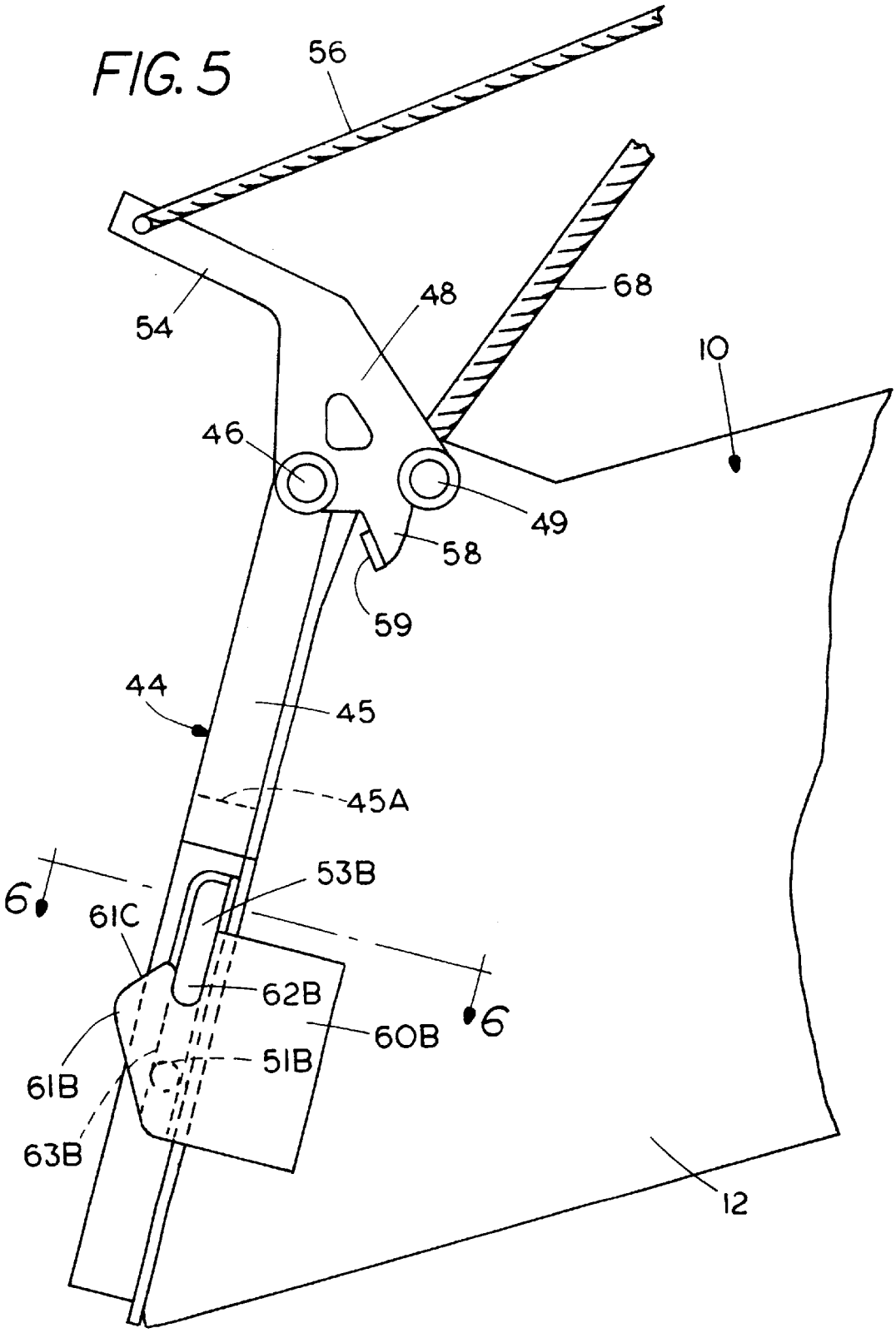
FIG. 5 is a fragmentary enlarged side view of the rear portion of the bucket of FIG. 1 showing the latches used with the present invention.

When the bucket 10 is at its desired dumping position, the drag cable 24 will be relaxed or slackened, so that the bucket 10 will pivot to lower the rear, and when in a position shown in FIG. 5, the link 56 tightens and further pivoting will cause the links to pull on the levers 54, which pivot about pivots 49 on the bucket wall portions 12A. At the same time, the pivot of 46 of the bellcrank 48 will be moved substantially parallel along the plane of the bucket sidewalls 12.

When the bucket pivots to the position shown in FIG. 7, the movement of the bellcranks pivot 46 is sufficient along the plane of the bucket sidewalls 12 so that the latch dog end portion 51A and 51B are pulled out of the slots 63A and 63B and the notches in which they are resting in the latches 60A and 60B and the end gate 44 then is unrestrained insofar as its lower edge is concerned. The end gate can then pivot about the axes of the pivot pins 46, which are on the bellcranks 48 mounted on opposite sides of the bucket. The end gate opens and the load is dumped as the drag cable slacken more.

Figure 8:
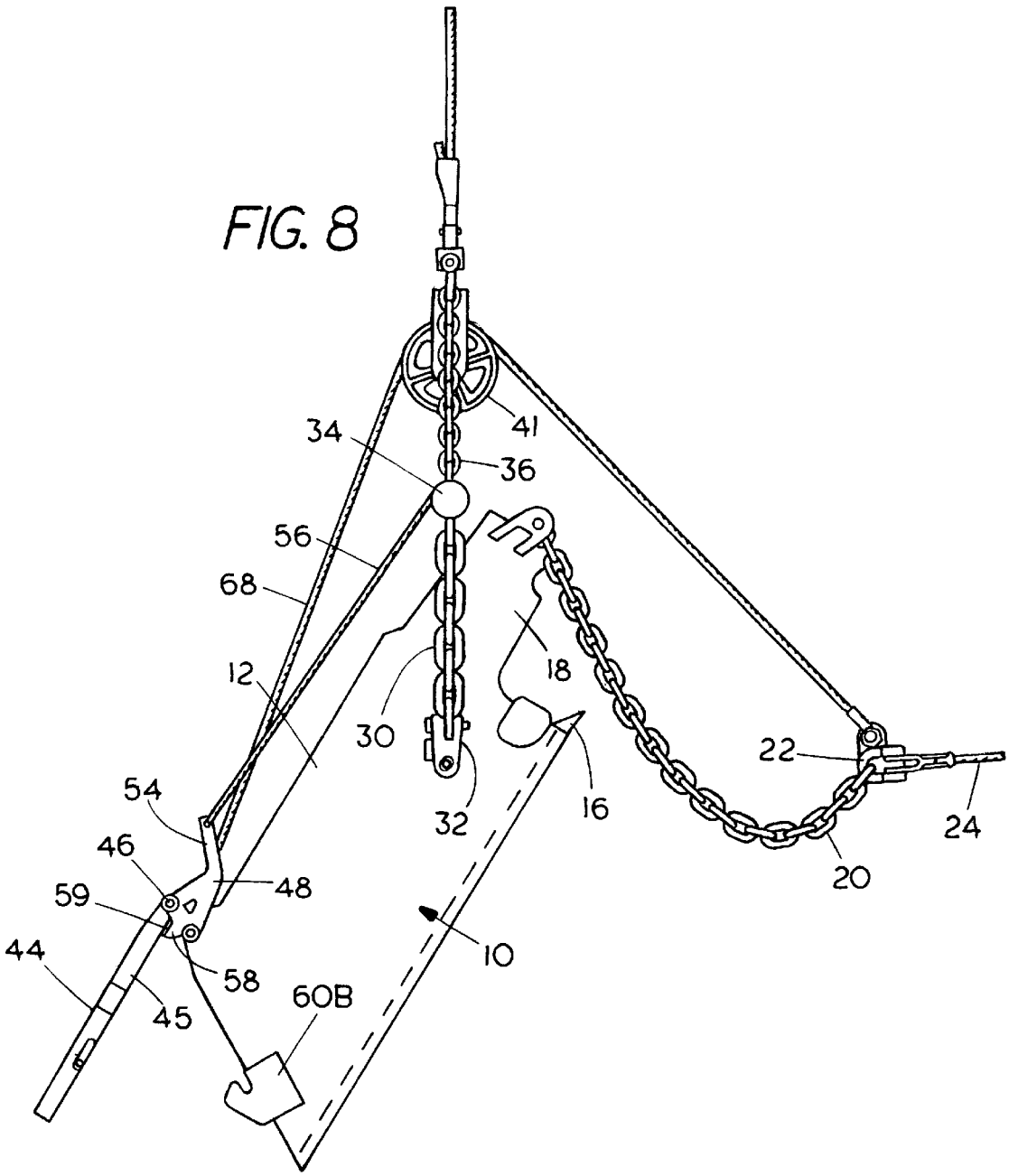
FIG. 8 is a side view showing the bucket of the present invention in a full dumping position, with the end gate swung open for dumping material out of the rear of the bucket.

Referring to FIGS. 5 and 7, it can be seen that the arms 58 have a bearing plate 59 that engages the forward surface of the upright frame members 45 of the end gate 44. As stated, the upright frame members 45 are on the outside of the sidewalls 12 and align with the arms 58. The bellcranks 48 will also pivot the end gate frame members 45 and the end gate assembly 44 outwardly when the bucket tilts toward its full dumping position which is shown in FIG. 8. The force from the arms 58 and the plates 59 ensures timely opening of the end gate 44 even if the load does not slide easily.

It can be seen in FIGS. 5 and 8 that the tag line 68 moves sufficiently as the drag cable 24 is slackened to let the rear end of the bucket move downwardly for dumping. The drag chains become slack. As shown in FIG. 8, the arms 58 and the reaction pads 59 engage the frame members 45 of the end gate to ensure that the end gate will not swing closed too early, as the bucket is moved back to its working or loading position.

The bucket, when empty, will be swung back towards it loading position, and the drag cable will be tightened, thereby causing the tag line 68 to pull the rear end of the bucket upwardly, and the control links or cables 56 will permit the bellcrank 48, and the lever end gate 54 to move counter clockwise as shown in FIG. 8 so that the end gate 44 will move back to its position shown in FIG. 5, on its way toward its closed position.

When the end gate 44 moves to the position shown in FIG. 9, the latch dog ends 51A and 51B will strike the ramps 63C of the latch plates 60 and pivot about the pivots 47A and 47B so they will align with and seat in latches 65A and 65B. Further movement of the rear portion of the bucket upwardly about the pivot axis of the pins 32 will permit the ends of the latch dogs 51A and 51B to slide downwardly into the slots 63A and 63B. The end gate 44 is again locked into usable or closed position. When the bucket 10 reaches its working position, the hoist line 39 will have been lowered sufficiently so that the bucket will engage the ground, and the drag chain will then pull the bucket 10 forwardly for loading in a normal manner.

The length of the end gate control links 56, which can be chains or cables, will determine the point at which the bellcrank 48 operates to lift the end gate 44 and release from the latch members. The links 56 are adjustable in length, either by removing or adding one or more chain links, or by using cable and adjusting the length of cable by changing the attachment points. The links 56 may be attached to lever arms with adjustable directly. Preferably, the rearward tilt of the floor of the bucket will be in the range of about 15° to 30° from the horizontal before the links 56 are tight. Adjustment holes for attachment of links 56 to the links arms 54 are for changing the lever arm length. The effective lever arm between the pivot 49 and the pivot 46 of the bellcrank, as well as the length of lever arm 54 can determine the force with which the end gate 44 is lifted from the latch members 60A and 60B. A high "breakout" force can be avoided by regulating the relationship of the lever arms. The effective lever arm on a line between pivot 49 and the pivot 46 is slightly greater than 90° with respect to the plane of the end gate, in the closed position as shown in FIG. 1, in order to minimize the "in and out" effect of the arc on the pivot point 46, and give a maximum movement for releasing the latch dog end portions 51A and 51B during this initial unlatching movement of the bellcrank 48. Approximately a 3:1 ratio between the length of the effective lever arm at the junction of the link 56 and the lever 54 to the pivot point 49 as compared of the length between pivot point 49 and pivot point 46, is provided.

Figure 10:
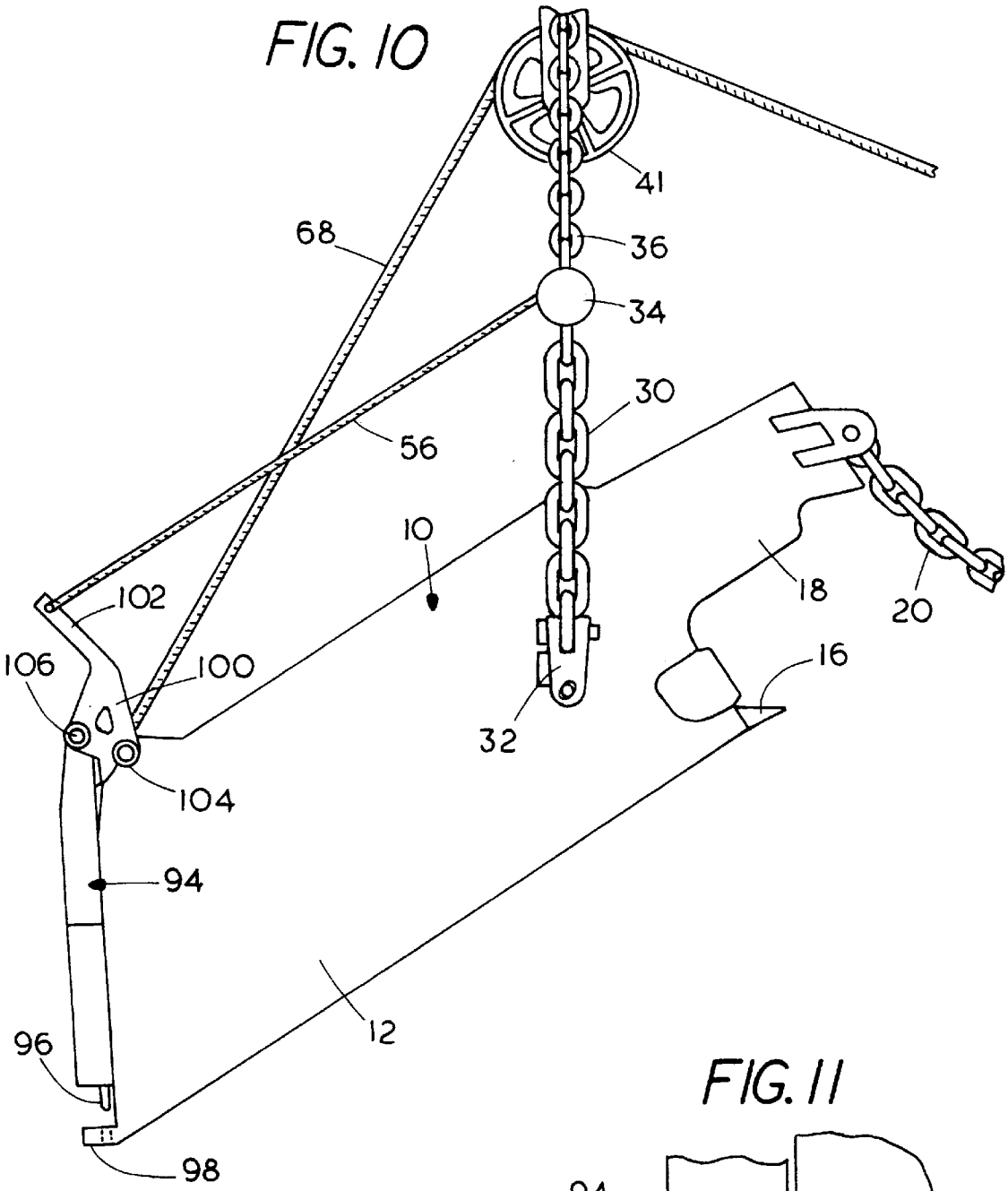
FIG. 10 is a side elevational view of a dragline bucket having an end gate latch made according to a second form of the present invention in a position similar to FIG. 7.
Figure 11:
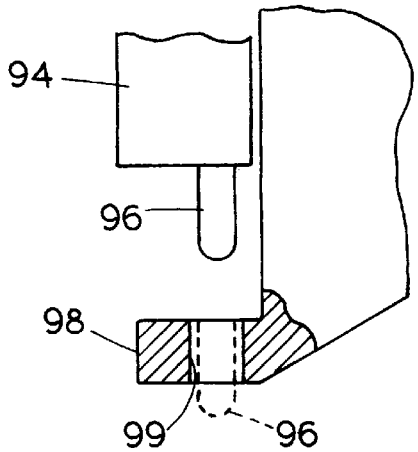
FIG. 11 is a fragmentary enlarged side view of the latch shown in FIG. 10.

In a second form of the latch used with the present invention, shown in FIGS. 10 and 11, end gate 94 has a pair of latch dogs or pins 96 on each side of the end gate which protrude downwardly from the bottom of the end gate. The end gate can be made as before, but the pivoting latches 42 are removed and the latch plates 60A and 60B are also removed. In this form of the invention the latch dogs 96 are like round pins, that are made to fit into openings 99 in latch plates 98. Latch plates 96 mount on the lower ends of the sidewalls, and align with the latch dogs 96. The opening in plates 98 receive the latch dogs, so that when the end gate is in the position as shown in dotted lines in FIG. 11, the end gate 94 is locked closed and will provide a closed end for the dragline bucket so that it can be filled full prior to dumping. The bucket and rigging are constricted as before and are numbered identically in FIGS. 10 and 11. The filling of the bucket and unloading swing is as in the first form of the invention, and when in position, the drag cable is slackened as described before. As this happens, the lines or links 56 tighten, pulling on the lever arms 102 of bellcranks 100 that are constructed as before. The bellcranks 100 are pivoted as at 104 to the sidewalls 12 of the bucket 10 and are pivoted to the end gate 94 at pivots 106. As the bellcranks 100 pivot about the pivot 104 on the bucket, the pivot 106 moves substantially parallel along the plane of the sidewall 12. The movement of the bellcrank pivot 106 is sufficient along the plane of the sidewalls 12 so that the latch dogs 96 are pulled out of the openings 99 in which they are positioned in the latch plates 98, and the end gate 94 then is unrestrained insofar as its lower edge is concerned and can pivot about the axis of the pivot pins 106, which are on the bellcranks 100.

The operation of the bucket is the same as in the first form of the invention, except the latches are different.

Various types of latches can be used, of course, including spring loaded latches that would yield for resetting, and be released in the same manner as the present operation, except that instead of lifting the gate, the bellcrank levers could lift the latch members.

Also, different types of latches can be used for the end gate itself, including latches along the sides of the end gate, or along the bottom edges and toward the center. The direct acting bellcrank that lifts the end gate as shown in the disclosed embodiments of the invention has substantial advantages.

The breakout force needed for releasing the end gate can be changed by changing the lever arrangement.

Although the present invention has been described with reference to preferred embodiments, workers skilled in the art will recognize that changes may be made in form and detail without departing from the spirit and scope of the invention.

What is claimed is:

1. An excavator bucket comprising a bucket body having sidewalls, and a floor, said sidewalls defining a front opening and a rear opening, a gate for closing the rear opening, and defining a gate plane, a draft member for moving the bucket to load material from a forward end of the bucket, and a hoist member for hoisting the bucket and connected to the bucket so that the bucket will dump rearwardly when loaded, a bellcrank arrangement mounting the gate to the sidewalls including a mounting pivot for the bellcrank relative to the sidewalls of the bucket, and a gate pivot on the bellcrank spaced from the mounting pivot and positioned so that when the bellcrank is rotated to move the gate pivot upwardly, the gate slides substantially along its plane, and a latch between the gate and the bucket releasable upon movement of said gate upwardly along said gate plane.

2. The bucket of claim 1 and a control link for operating said bellcrank, said control link being operatively connected to a hoist chain spreader bar member such that as a rear of the bucket tilts downwardly, the link exerts a force on the bellcrank to pivot the bellcrank and move the gate along its plane.

3. The bucket of claim 2 wherein said link comprises a flexible member having one end connected to the hoist chain spreader bar member, and having a length such that as the bucket tilts rearwardly the gate is slid to release from the latch.

4. The bucket of claim 2 wherein said latch is releasable and latchable upon movement along the gate plane of the gate, said bucket being pivotally movable from a dumping position toward a working position, and said gate resting against a rear end of the bucket as the bucket moves from a dumping to working position and subsequently the bellcrank moving to permit the gate to slide downwardly along a rear end of the bucket to latch the gate in position.

5. The bucket of claim 2 and a tag line connected between the draft member and a rear portion of the bucket to control a tilting position of the bucket.

6. The bucket of claim 1 wherein said hoist member comprises a support connected to the bucket about a generally horizontal pivot axis.

7. The bucket of claim 1 wherein said latch comprises latch dogs on the gate, and latch receptacles mounted on the bucket, said latch dogs being engageable with said latch receptacles upon movement of the gate in direction parallel to its plane between latched and unlatched positions, the bellcrank having sufficient operating lengths to move said gate between its latched and unlatched positions.

8. The bucket of claim 7 wherein said latch dogs are pivotally mounted to the exterior of said gate and have portions that extend laterally from said gate, and said latch receptacles being positioned on opposite sides of the bucket and fastened to the side walls thereof.

9. The bucket of claim 8 wherein said latch dogs are biased to pivot to a lower position for latching, and being free to pivot upwardly, movement of said bellcrank moving the latch dogs out of the receptacles, said latch having ramp surfaces that lead to said receptacles, said latch dogs engaging said ramp surfaces as said gate moves to its latched position, and said latch dogs sliding into said receptacles as the gate moves to close the end of the bucket.

10. The bucket of claim 7 wherein said latch dogs comprise pins lying generally parallel to the plane of the gate, and the latch receptacles are in the bucket positioned to receive said pins, said bellcranks moving said gate along its plane to sufficiently withdraw the pins from the latch receptacles when the bucket tilts rearwardly, and to permit the pins to move into said latch receptacles as the bucket again returns to a horizontal position.

11. A dragline bucket and rigging for a rear dumping bucket, comprising a bucket having side walls and a floor, an end gate for closing a rear opening of said bucket, a dragchain for moving said bucket forwardly for loading the bucket, and a hoist rigging pivotally mounted to said bucket along said side walls thereof for permitting said bucket to pivot about a generally horizontal bucket pivot axis, said bucket pivot axis being positioned such that the bucket tilts rearwardly when loaded, and the pivoting being controllable by a dragcable at a forward end of the bucket, a tag line connected to the forward end of the drag chain and to a rear portion of the bucket to provide a force controlling the bucket position about an axis of the hoist rigging, and an automatic end gate for closing the rear opening of the bucket during loading and hoisting operations, and opening during dumping operations comprising a pair of bellcranks pivotally mounted to the side walls adjacent to upper edges thereof, and the end gate being pivotally mounted to said bellcranks at a location spaced from the pivot of the bellcranks to the side walls, the bellcranks, when pivoted, causing movement of the end gate generally along a plane formed by the end of the side walls, a latch on the bucket that will hold the end gate in a closed position, and will release upon movement of the end gate upwardly generally along the plane of the end gate to an unlatched portion, and a control link connected to each of said bellcranks and connected to a hoist chain spreader bar rigging such that the bellcranks are pivoted and move the end gate to release latchbars of the end gate when the bucket pivots about the bucket pivot axis for rear dumping a selected number of degrees.

12. The dragline bucket and rigging of claim 11 wherein said latch comprises a part of pivotally mounted latch dogs carried on the end gate, said latch dogs having end portions protruding laterally from the end gate, and latch plates having slots for receiving the end portions on each side of the bucket, said slots being generally parallel to the plane of the end gate in its closed position.

13. The dragline bucket and rigging assembly of claim 12 wherein the pivoting latch dogs act under gravity so that the end portions pivot downwardly, and a ramp surface on each of said latch plates for engaging the end portions and lifting the end portions to move into the slots of the latches as the end gate moves toward the rear opening of the bucket.

14. The dragline bucket and rigging assembly of claim 12 wherein said bellcranks are connected to the hoist chain spreader bar rigging by flexible links, said links being of selected length so that as said bucket pivots about the bucket pivot axis rearwardly for dumping, the bellcranks are pivoted to move the end gate thereby vertically to an unlatched position, said end gate being free to swing open from loads being dumped from the rear opening of the bucket.

15. An excavator bucket comprising a bucket body having sidewalls, and a floor, said sidewalls defining a front opening and a rear opening, a gate for closing the rear opening, and defining a gate plane, a draft member for moving the bucket to load material from a forward end of the bucket, and a hoist member for hoisting the bucket and connected to the bucket so that the bucket will dump rearwardly when loaded, a pair of levers, one on each of the sidewalls, a mounting pivot for each lever on the respective sidewall of the bucket, and a gate pivot on each lever spaced from the respective mounting pivot and positioned so that when the levers are rotated to move the gate pivot upwardly, the gate slides substantially along a gate plane, and a latch between the gate and the bucket releasable upon movement of said gate upwardly along said gate plane.

16. The bucket of claim 15 and links for operating said levers, respectively said links being operatively connected to the hoist member, such that as a rear of the bucket tilts downwardly, the links exert a force on the levers to pivot the levers to move the gate along the gate plane.

* * * * *